US009066610B2

(12) United States Patent
Duan

(10) Patent No.: US 9,066,610 B2
(45) Date of Patent: Jun. 30, 2015

(54) INFANT BASKET HAVING HIDDEN LATCH MEANS

(71) Applicant: Wonderland Nurserygoods Company Limited, Central (HK)

(72) Inventor: Xiao-Song Duan, Dongguan (CN)

(73) Assignee: Wonderland Nursery Goods Company Limited, Taipei (TW)

( * ) Notice: Subject to any disclaimer, the term of this patent is extended or adjusted under 35 U.S.C. 154(b) by 102 days.

(21) Appl. No.: 14/014,923

(22) Filed: Aug. 30, 2013

(65) Prior Publication Data

US 2014/0084032 A1 Mar. 27, 2014

(30) Foreign Application Priority Data

Sep. 7, 2012 (CN) ..... 2012 2 0455658 U

(51) Int. Cl.
*A47C 31/00* (2006.01)
*A47D 13/02* (2006.01)

(52) U.S. Cl.
CPC ..... *A47D 13/02* (2013.01)

(58) Field of Classification Search
CPC ..... A47D 13/02; A47D 13/025
See application file for complete search history.

(56) References Cited

U.S. PATENT DOCUMENTS

| | | | | |
|---|---|---|---|---|
| 4,516,806 | A * | 5/1985 | McDonald et al. | 297/452.13 |
| 5,143,419 | A * | 9/1992 | Tepper et al. | 297/183.3 |
| 5,507,564 | A * | 4/1996 | Huang | 297/452.13 |
| 7,726,731 | B2 * | 6/2010 | Jane Santamaria | 297/130 |
| 8,936,261 | B2 * | 1/2015 | Yuan | 280/47.38 |
| 2003/0151220 | A1 * | 8/2003 | Hou | 280/47.371 |
| 2013/0009428 | A1 * | 1/2013 | Heisey | 297/183.2 |

* cited by examiner

*Primary Examiner* — Philip Gabler
(74) *Attorney, Agent, or Firm* — Schwabe Williamson & Wyatt PC

(57) ABSTRACT

An infant basket comprises: a basket body; two pivot plates formed with notches; two hollow connectors pivoted to the pivot plates; two latch members mounted in the hollow connectors and operable to engage and disengage the notches; and a handle having two hollow end portions. The hollow connectors are mounted detachably in the hollow end portions such that the latch members are disposed within the hollow end portions. The latch members are co-rotatable with the handle and the hollow connectors relative to the pivot plates about a rotation axis from an upright position to a lie-back position relative to the basket body when the latch members are disengaged from the notches, respectively.

9 Claims, 6 Drawing Sheets

INFANT BASKET HAVING HIDDEN LATCH MEANS

CROSS-REFERENCE TO RELATED APPLICATION

This application claims priority of Chinese Patent Application No. 201220455658.8, filed on Sep. 7, 2012.

BACKGROUND OF THE INVENTION

1. Field of the Invention

This invention relates to an infant basket, more particularly to an infant basket having a handle and latch members that are operable to position the handle and that are hidden in hollow connectors which are detachably connected to the handle.

2. Description of the Related Art

U.S. Patent Application Publication No. 2013/0009428 discloses an infant carrier that includes a seat bucket, a handle with left and right hubs, left and right handle locks, left and right springs urging respectively the left and right handle locks, left and right lock supports, left and right guide beams, and left and right levers. The handle is pivoted to the seat bucket about an axis. The seat bucket has left and right sockets that are respectively coupled to the left and right hubs in a rotatively bearing engaging manner and that have lock receivers. The left and right hubs respectively cooperate with the left and right sockets to define left and right accommodating spaces therebetween, respectively. The left and right handle locks, the left and right springs, the left and right lock supports, the left and right guide beams, and portions of the left and right levers are all disposed in the respective left and right accommodating spaces. The left and right handle locks are respectively and movably disposed in the left and right accommodating spaces, and are respectively engageable with the lock receivers of the left and right sockets so as to position the handle at a desired position. The left and right levers are mounted movably on the handle to drive movements of the left and right handle locks from a locked position to an unlocked position. Since the handle is in a rotatively bearing engagement with the left and right sockets, detachment of the handle from the left and right sockets for repair purposes can be relatively difficult and inconvenient. In addition, since each of the left and right accommodating spaces is relatively small, the dimensions of the left and right handle locks and the dimensions of the left and right springs are required to be small in order to be fitted into the left and right accommodating spaces, which results in inconvenience and difficulty in installation of the left and right handle locks and the left and right springs.

SUMMARY OF THE INVENTION

Therefore, an object of the present invention is to provide an infant basket that can overcome the aforesaid drawbacks associated with the prior art.

According to this invention, there is provided an infant basket having hidden latch means. The infant basket comprises: a basket body adapted to receive an infant therein and having a top open end with two opposite lateral sides; two opposite pivot plates connected to the opposite lateral sides of the top end of the basket body, respectively, each of the pivot plates being formed with a notch; two hollow connectors pivoted to the pivot plates, respectively; two latch members respectively mounted movably to and hidden in the hollow connectors and operable to engage and disengage the notches in the pivot plates, respectively; and a handle having two opposite hollow end portions, each of which defines an accommodating space therein. The hollow connectors are mounted respectively and detachably to the hollow end portions of the handle and respectively extend into the accommodating spaces in the hollow end portions of the handle such that the latch members are disposed within the accommodating spaces, respectively. The latch members are co-rotatable with the handle and the hollow connectors relative to the pivot plates about a rotation axis from an upright position to a lie-back position relative to the basket body when the latch members are disengaged from the notches, respectively.

BRIEF DESCRIPTION OF THE DRAWINGS

In drawings which illustrate an embodiment of the invention.

DETAILED DESCRIPTION OF THE PREFERRED EMBODIMENT

Figure 1:
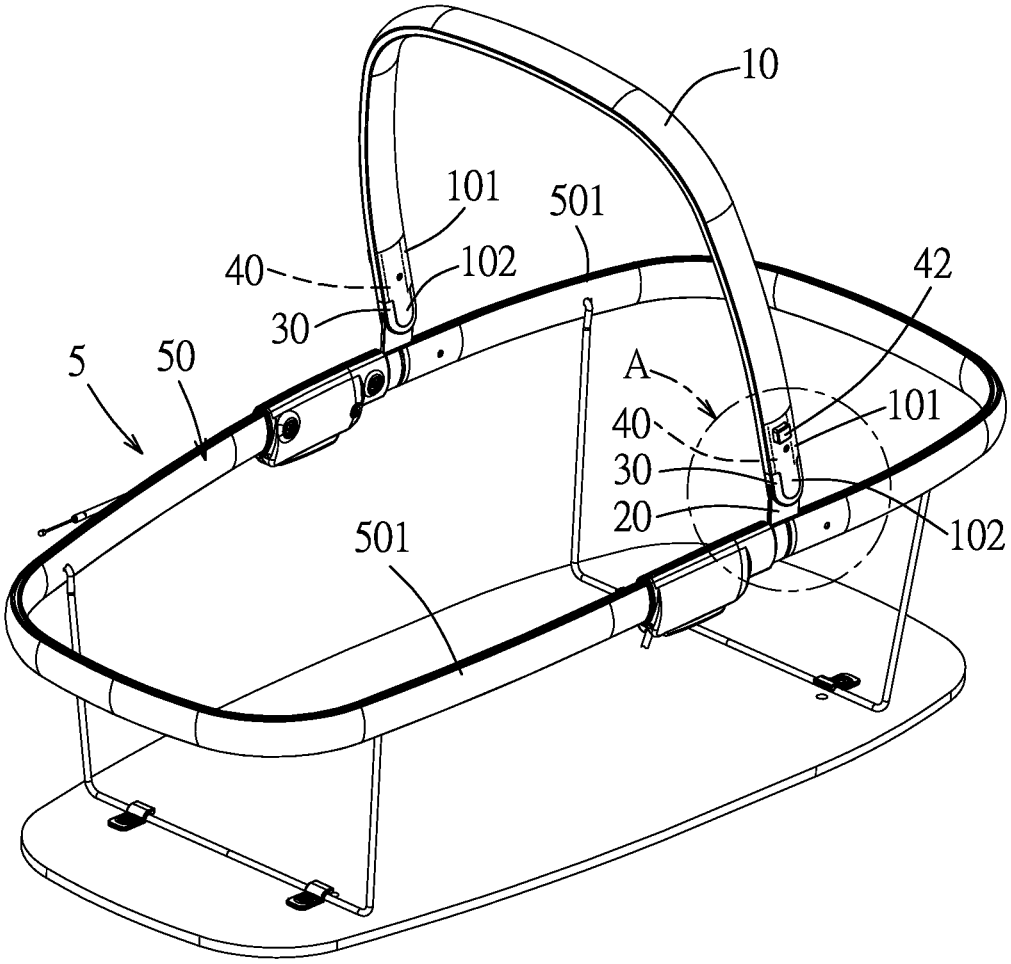
FIG. 1 is a perspective view of the preferred embodiment of an infant basket according to the present invention, illustrating a state where a handle is disposed at an upright position.
Figure 2:
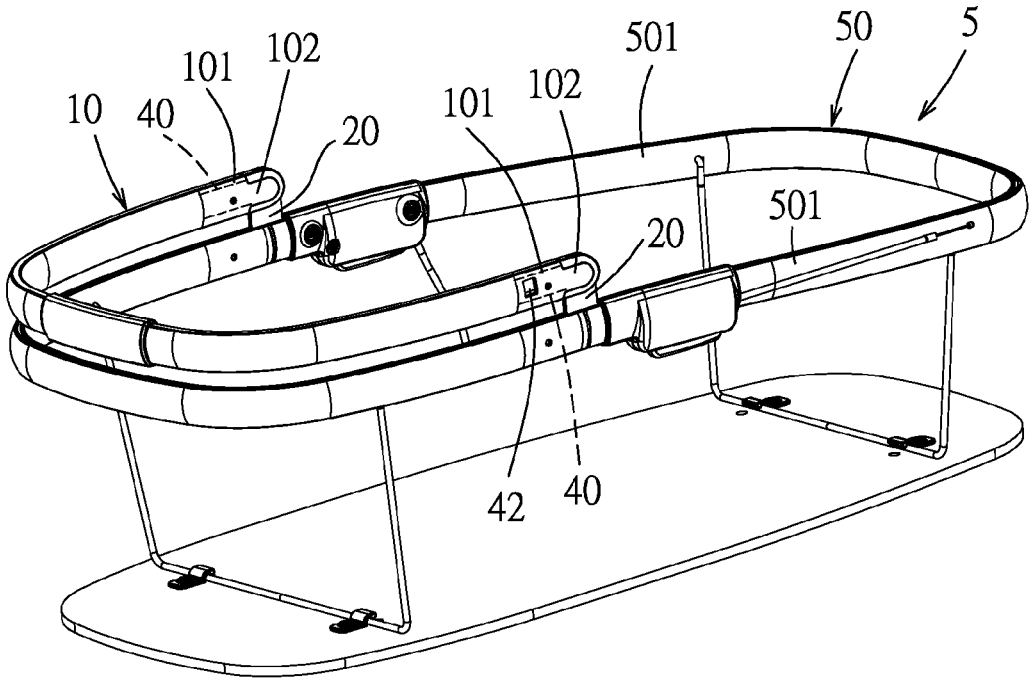
FIG. 2 is a perspective view of the preferred embodiment illustrating another state where the handle is disposed at a lie-back position.
Figure 3:
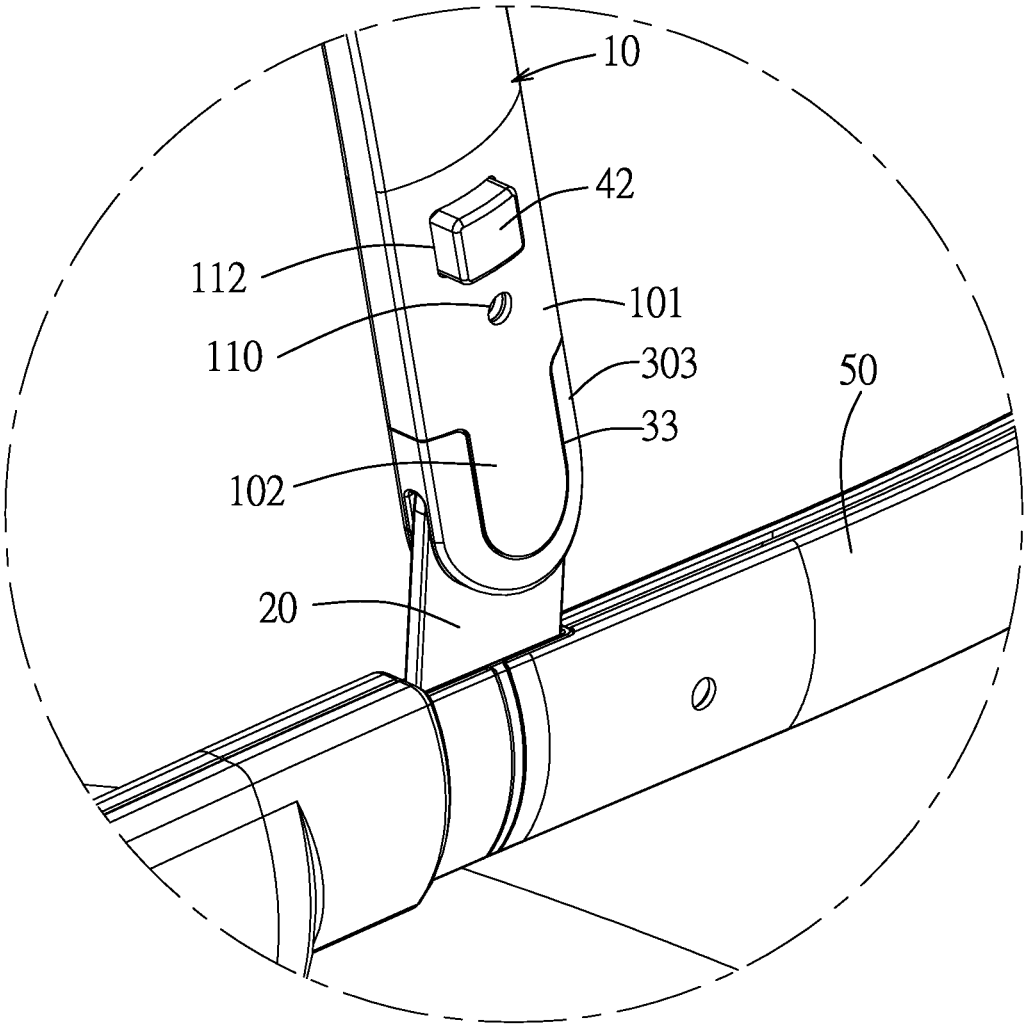
FIG. 3 is an enlarged view within the circle A of FIG. 1.

FIGS. 1 to 5 illustrate the preferred embodiment of an infant basket having hidden latch means according to the present invention. The infant basket includes a basket body 5, two opposite pivot plates 20, two hollow connectors 30, two latch members 40, a handle 10, two urging members 43 (only one is shown), two operating knobs 42 (only one can be seen), two connecting pins 44 (only one is shown), and two pivot pins 60 (only one is shown).

The basket body 5 is adapted to receive an infant therein, and has a top open end 50 with two opposite lateral sides 501. The pivot plates 20 are securely connected to and extend upright from the lateral sides 501 of the top open end 50 of the basket body 5, respectively. Each of the pivot plates 20 is formed with first and second notches 201, 202 that are angularly displaced from each other by an angle greater than 90 degrees and smaller than 120 degrees.

Figure 4:
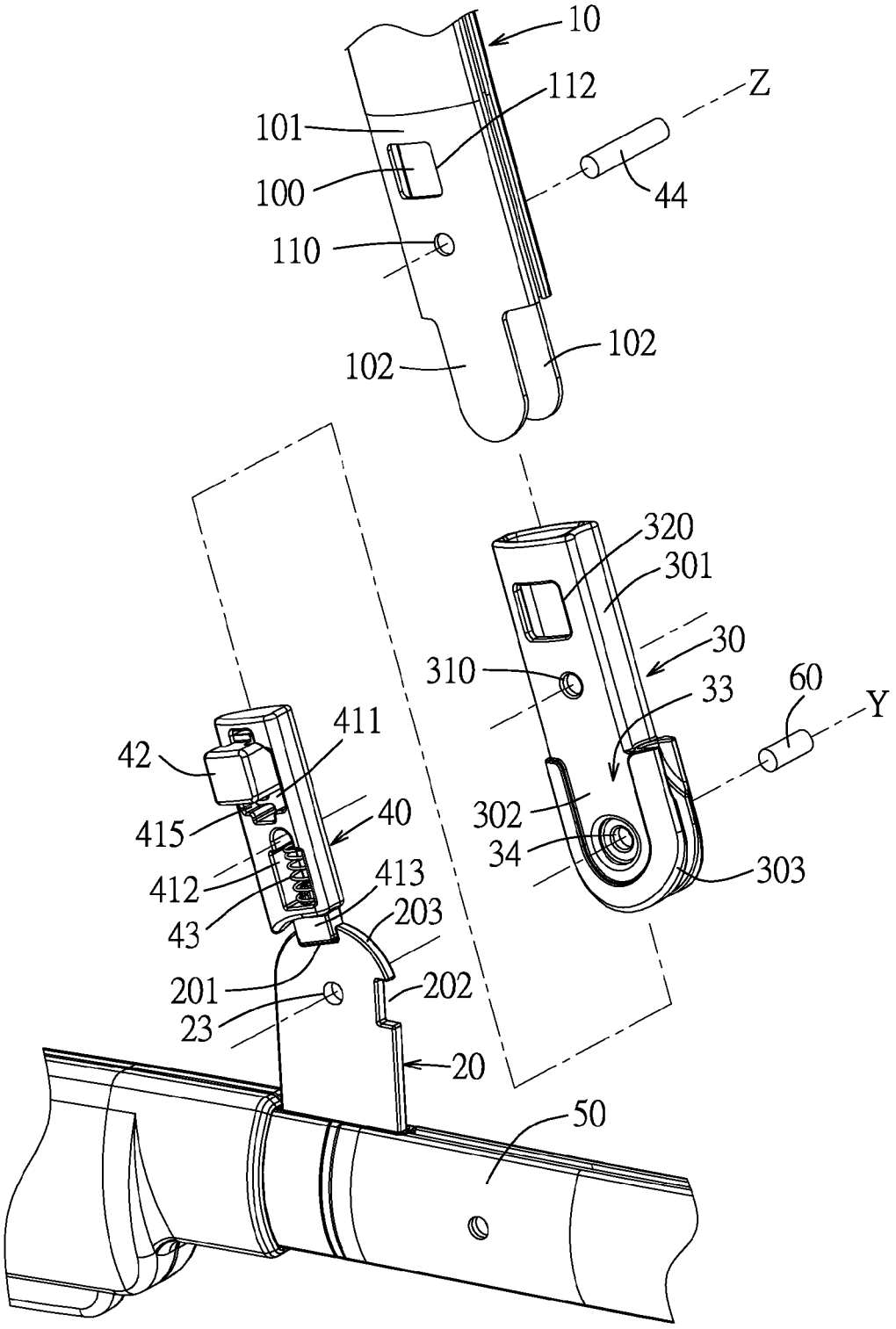
FIG. 4 is a fragmentary exploded perspective view of the preferred embodiment.
Figure 5:
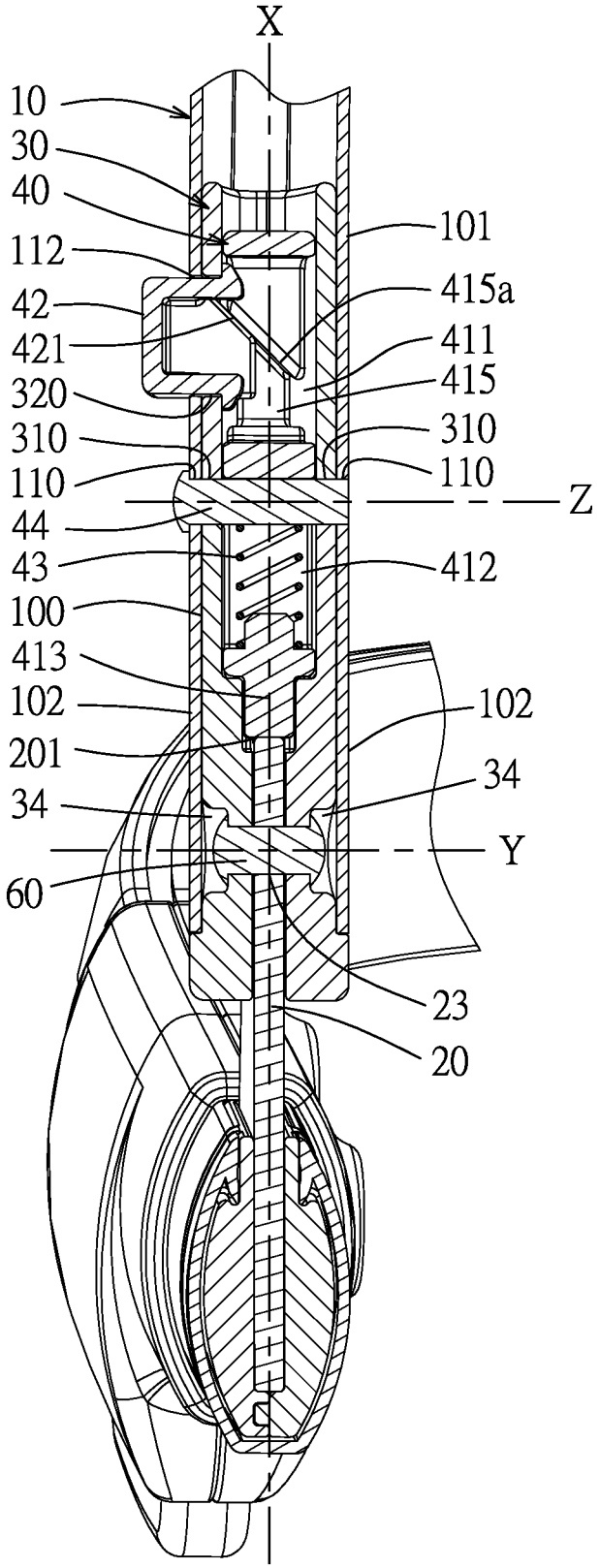
FIG. 5 is a fragmentary sectional view of the preferred embodiment illustrating a state where a latch member engages a notch in a pivot plate.

The hollow connectors 30 are pivoted to the pivot plates 20 through the pivot pins 60, respectively. Each of the hollow connectors 30 has a first segment 301 that extends in a length direction (X), a second segment 302 that extends from the first segment 301 in the length direction (X), and a U-shaped flange 303 that extends outwardly from a periphery of the second segment 302. The U-shaped flange 303 defines two opposite receiving grooves 33 (only one is seen in FIG. 4). The pivot plates 20 extend into the second segments 302 of the hollow connectors 30, respectively.

The handle 10 has two opposite hollow end portions 101, each of which defines an accommodating space 100 therein, and each of which has two opposite insertion walls 102. The hollow connectors 30 are mounted detachably and respectively to the hollow end portions 101 of the handle 10, and extend respectively into the accommodating spaces 100 in the hollow end portions 101 of the handle 10.

The first segment 301 of each of the hollow connectors 30 is received in the accommodating space 100 in the respective one of the hollow end portions 101. The insertion walls 102 of each of the hollow end portions 101 are fitted into the receiving grooves 33 in the U-shaped flange 303 of the second segment 302 of the respective one of the hollow connectors 30, respectively. Each of the pivot pins 60 extends through a pair of pivot holes 34 in the second segment 302 of the respective one of the hollow connectors 30 and a pivot hole 23 in the respective one of the pivot plates 20. The insertion walls 102 of each of the hollow end portions 101 of the handle 10 cover two opposite ends of a respective one of the pivot pins 60, respectively.

Figure 6:
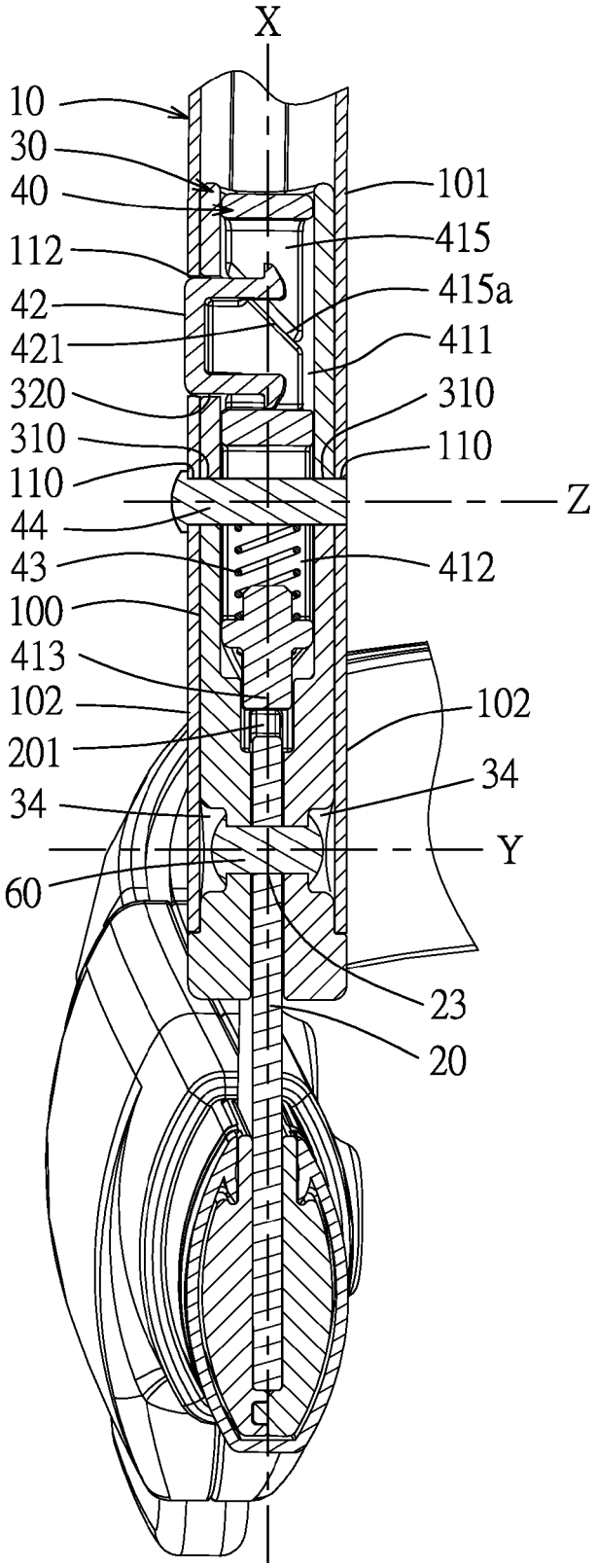
FIG. 6 is a fragmentary sectional view of the preferred embodiment illustrating another state where the latch member is disengaged from the notch in the pivot plate.

The latch members 40 are mounted movably and are hidden in the hollow connectors 30, so that the latch members are respectively disposed and hidden within the accommodating spaces 100 of the hollow end portions 101 of the handle to avoid adverse effects on the outer appearance of the infant basket. Each of the latch members is formed with an engaging tongue 413 protruding therefrom. Each of the latch members 40 extends in the length direction (X), and is formed with an elongate slot 412 and a cam-receiving recess 411 defined by a recess-defining wall 415. The recess-defining wall 415 has a slanted face 415*a* that is inclined relative to the length direction (X). The latch members 40 are operable to respectively engage and disengage the first notches 201 of the pivot plates 20 (see FIGS. 5 and 6) by respectively extending the engaging tongues 413 thereof into and out of the first notches 201 or to respectively engage and disengage the second notches 201 of the pivot plates 20 (not shown) by extending the engaging tongues 413 thereof into and out of the second notches 201, respectively.

Each of the connecting pins 44 extends in a transverse direction (Z) transverse to the length direction (X) through a pair of through-holes 110 in a respective one of the hollow end portions 101 of the handle 10, a pair of through-holes 310 in the first segment 301 of a respective one of the hollow connectors 30, and the elongate slot 412 in a respective one of the latch members 40 such that the handle 10, the latch members 40 and the hollow connectors 30 are coupled together.

Each of the urging members 43 is mounted in the elongate slot 412 in a respective one of the latch members 40, and abuts against a respective one of the connecting pins 44 and the respective one of the latch members 40 so as to urge the respective one of the latch members 40 in the length direction (X).

Each of the operating knobs 42 extends movably through an aperture 112 in a respective one of the hollow end portions 101 of the handle 10 and an aperture 320 in a respective one of the hollow connectors 30 and into the cam-receiving recess 411 in a respective one of the latch members 40 for pushing the respective latch member 40. The elongate slots 412 have a length that permits peripheries of the elongate slots 412 to respectively pass over the connecting pins 44 when the latch members 40 are driven respectively by the operating knobs 42 to move in the length direction (X). In this embodiment, each of the operating knobs 42 has a slanted face 421 that is in sliding contact with the slanted face 415*a* of the recess-defining wall 415 of the respective one of the latch members 40, and is pressible in the transverse direction (Z) to slide on the slanted face 415*a* of the recess-defining wall 415 for driving movement of the respective one of the latch members 40 against the urging action of the respective one of the urging members 43 in the length direction (X) away from the respective one of the pivot plates 20 (see FIGS. 5 and 6), thereby permitting disengagement of the respective one of the latch members 40 from the first notch 201 of the respective pivot plate 20. Each of the operating knobs 42 further has protrusions that are movably coupled to a periphery of the aperture 320 in the respective one of the hollow connectors 30 in a snap-fit engaging manner.

The latch members 40 are co-rotatable with the handle 10 and the hollow connectors 30 relative to the pivot plates 20 about a rotation axis (Y) from a lie-back position (see FIG. 2) to an upright position (see FIG. 1) relative to the basket body 5 for respectively engaging with the first notches 201 to position the handle 10 at the upright position when the latch members 40 are disengaged from the second notches 202, respectively, and when the handle 10 is pulled up by an external force, and from the upright position to the lie-back position relative to the basket body 5 for engaging with the second notches 202 to position the handle 10 at the lie-back position when the latch members 40 are disengaged from the first notches 201, respectively, and when the handle 10 is pulled down by an external force or the force of gravity. Each of the connecting pins 44 is parallel to the rotation axis (Y). It is noted that the upright position of the handle 10 relative to the basket body 5 is an angular position which is suitable for the user to carry the infant basket and which forms an angle between the handle 10 and the basket body 5 that ranges preferably from 80 degrees to 100 degrees. In addition, when the handle 10 is disposed at the lie-back position, the angle between the handle 10 and the basket body 5 should be suitable for placing and removing an infant in and out of the infant basket, and is preferably close to zero degrees.

Each of the pivot plates 20 has a round free end 203 that extends circumferentially about the rotation axis (Y). The first notch 201 in each of the pivot plates 20 is formed at the round free end 203, and extends inwardly of the round free end 203 and radially toward the rotation axis (Y). Each of the latch members 40 extends radially and outwardly from the round free end 203 of the respective one of the pivot plates 20 away from the rotation axis (Y) when being disposed at the upright position relative to the basket body 5.

With the inclusion of the hollow connectors 30 that are detachably connected to the handle 10 in the infant basket of this invention, the aforesaid drawback with respective to the detachment of the handle from the left and right sockets associated with the prior art can be eliminated. Moreover, the outward extension of the latch members 40 together with the first segments 301 of the hollow connectors 30 from the round free ends 203 of the pivot plates 20 can provide more space for installation of the connecting pins 44, the urging members 43 and the operating knobs 42, thereby alleviating the aforesaid drawback with respective to the inconvenient and difficult installation as encountered in the prior art.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. An infant basket having hidden latch means, said infant basket comprising:

a basket body adapted to receive an infant therein and having a top open end with two opposite lateral sides;

two opposite pivot plates connected to said opposite lateral sides of said top end of said basket body, respectively, each of said pivot plates being formed with a first notch;

two hollow connectors pivoted to said pivot plates, respectively;

two latch members respectively mounted movably to and hidden in said hollow connectors and operable to engage and disengage said first notches in said pivot plates, respectively; and a handle having two opposite hollow end portions, each of which defines an accommodating space therein;

wherein said hollow connectors are mounted respectively and detachably to said hollow end portions of said handle and respectively extend into said accommodating spaces in said hollow end portions of said handle, such that said latch members are disposed within said accommodating spaces, respectively; and wherein said latch members are co-rotatable with said handle and said hollow connectors relative to said pivot plates about a rotation axis from an upright position to a lie-back position relative to said basket body when said latch members are disengaged from said first notches, respectively;

said infant basket further comprising two urging members and two operating knobs, each of said latch members extending in a length direction and being formed with a cam-receiving recess defined by a recess-defining wall, said recess-defining wall having a slanted face that is inclined to the length direction, each of said urging members urging a respective one of said latch members in the length direction, each of said operating knobs extending movably into said cam-receiving recess in a respective one of said latch members, having a slanted face that is in sliding contact with said slanted face of said recess-defining wall of the respective one of said latch members, and being pressible to slide on said slanted face of said recess-defining wall for driving movement of the respective one of said latch members against the urging action of the respective one of said urging members in the length direction away from the respective one of said pivot plates, thereby permitting disengagement of the respective one of said latch members from said first notch in the respective one of said pivot plates.

2. The infant basket of claim 1, wherein said pivot plates extend into said hollow connectors, respectively.

3. The infant basket of claim 1, wherein each of said operating knobs is pressible in a transverse direction transverse to the length direction to slide on said slanted face of said recess-defining wall.

4. The infant basket of claim 1, wherein each of said hollow connectors has a first segment that extends in the length direction, a second segment that extends from said first segment in the length direction, and a U-shaped flange that extends outwardly from a periphery of said second segment, said U-shaped flange defining two opposite receiving grooves, each of said hollow end portions of said handle having two opposite insertion walls, said first segment of each of said hollow connectors being received in said accommodating space in the respective one of said hollow end portions, said insertion walls of each of said hollow end portions being fitted into said receiving grooves in said U-shaped flange of said second segment of the respective one of said hollow connectors, respectively.

5. The infant basket of claim 4, further comprising two connecting pins, each of said latch members being formed with an elongate slot, each of said connecting pins extending in a transverse direction transverse to the length direction through a respective one of said hollow end portions of said handle, said first segment of a respective one of said hollow connectors and said elongate slot in a respective one of said latch members, said elongate slots of said latch members having a length that permits peripheries of said elongate slots to pass over said connecting pins when said latch members are driven by said operating knobs to move in the length direction, each of said urging members being mounted in said elongate slot in a respective of said latch members and abutting against a respective one of said connecting pins and the respective one of said latch members.

6. The infant basket of claim 4, further comprising two pivot pins, said hollow connectors being respectively pivoted to said pivot plates through said pivot pins, respectively, each of said pivot pins extending through said second segment of the respective one of said hollow connectors and the respective one of said pivot plates, said insertion walls of each of said hollow end portions of said handle covering two opposite ends of a respective one of said pivot pins, respectively.

7. The infant basket of claim 1, wherein each of said pivot plates is further formed with a second notch that is angularly displaced from said first notch, said latch members being further operable to engage and disengage said second notches in said pivot plates, respectively, said latch members being co-rotatable with said handle and said hollow connectors relative to said pivot plates about the rotation axis from the lie-back position to the upright position relative to said basket body when said latch members are disengaged from said second notches, respectively.

8. The infant basket of claim 7, wherein said first and second notches in each of said pivot plates are angularly displaced from each other by an angle greater than 90 degrees and smaller than 120 degrees.

9. The infant basket of claim 1, wherein each of said pivot plates has a round free end that extends circumferentially about the rotation axis, said first notch being formed at said round free end and extending inwardly of said round free end and radially toward the rotation axis, each of said latch members extending radially and outwardly from said round free end of the respective one of said pivot plates away from the rotation axis when being disposed at the upright position relative to said basket body.

* * * * *